US007207268B2

(12) United States Patent
Brunst

(10) Patent No.: US 7,207,268 B2
(45) Date of Patent: Apr. 24, 2007

(54) APPARATUS AND METHOD OF ENHANCING PRINTING PRESS CYLINDERS

(75) Inventor: George E Brunst, Bradenton, FL (US)

(73) Assignee: NU Tech Coatings LLC, Johnson City, TN (US)

( * ) Notice: Subject to any disclaimer, the term of this patent is extended or adjusted under 35 U.S.C. 154(b) by 85 days.

(21) Appl. No.: 10/909,783

(22) Filed: Jul. 30, 2004

(65) Prior Publication Data

US 2006/0021530 A1 Feb. 2, 2006

(51) Int. Cl.
*B41F 13/10* (2006.01)

(52) U.S. Cl. ..... 101/376; 101/375

(58) Field of Classification Search ..... None
See application file for complete search history.

(56) References Cited

U.S. PATENT DOCUMENTS

| | | | | |
|---|---|---|---|---|
| 3,043,211 | A | 7/1962 | Appenzeller | 100/170 |
| 3,146,709 | A | 9/1964 | Bass et al. | 101/375 |
| 3,475,803 | A | 11/1969 | Hill | 492/56 |
| 3,673,025 | A | 6/1972 | Fukuyama et al. | 156/154 |
| 3,959,574 | A | 5/1976 | Seanor et al. | 492/56 |
| 3,978,254 | A | 8/1976 | Hoexter et al. | 428/36.91 |
| 4,030,415 | A | 6/1977 | Fellows | 101/382 R |
| 4,044,678 | A | 8/1977 | Rasmussen | 101/378 |
| 4,089,265 | A | 5/1978 | White et al. | 101/375 |
| 4,119,032 | A | 10/1978 | Hollis | 101/216 |
| 4,144,812 | A | 3/1979 | Julian | 101/382 R |
| 4,144,813 | A | 3/1979 | Julian | 101/382 R |
| 4,296,172 | A | 10/1981 | Hill | 428/331 |
| 4,381,709 | A | 5/1983 | Katz | 101/375 |
| 4,496,434 | A | 1/1985 | Morssinkhof | 204/11 |
| 4,554,040 | A | 11/1985 | Vandervelden | 156/215 |
| 4,794,858 | A | 1/1989 | Katz | 101/375 |
| 4,903,597 | A | 2/1990 | Hoage et al. | 101/401.1 |
| 5,206,992 | A | 5/1993 | Carlson et al. | 29/895.32 |
| 5,316,798 | A | 5/1994 | Tittgemeyer | 427/409 |
| 5,544,584 | A | 8/1996 | Thompson et al. | 101/401.1 |
| 5,787,811 | A * | 8/1998 | Achelpohl et al. | 101/349.1 |
| 2002/0096066 | A1* | 7/2002 | Callahan et al. | 101/183 |
| 2003/0205156 | A1* | 11/2003 | Belanger et al. | 101/376 |
| 2003/0213389 | A1* | 11/2003 | Kolbe et al. | 101/382.1 |
| 2004/0113310 | A1* | 6/2004 | Keating | 264/219 |
| 2004/0226461 | A1* | 11/2004 | Langsch et al. | 101/148 |
| 2005/0064181 | A1* | 3/2005 | Blank et al. | 428/354 |
| 2005/0150406 | A1* | 7/2005 | Kanga et al. | 101/395 |
| 2005/0257706 | A1* | 11/2005 | Simon et al. | 101/376 |

* cited by examiner

*Primary Examiner*—Daniel J. Colilla
(74) *Attorney, Agent, or Firm*—Harness, Dickey & Pierce, P.L.C.

(57) ABSTRACT

A printing press cylinder and a method of manufacturing the same. The printing press cylinder includes a rigid base member having a reduced radius section and a polymer layer formed about the rigid base member generally within the reduced radius section. The polymer layer is operable to absorb forces and dissipate energy that degrades print quality. A gear portion is operably coupled to the rigid base member for rotation therewith. The printing press cylinder is manufactured by turning a rigid base member to produce a reduced radius section and subsequently molding a polymer layer generally within the reduced radius section of the rigid base member. The polymer layer is cured and then turned to reduce the circumference thereof and produce a smooth surface.

5 Claims, 3 Drawing Sheets

FIG 4
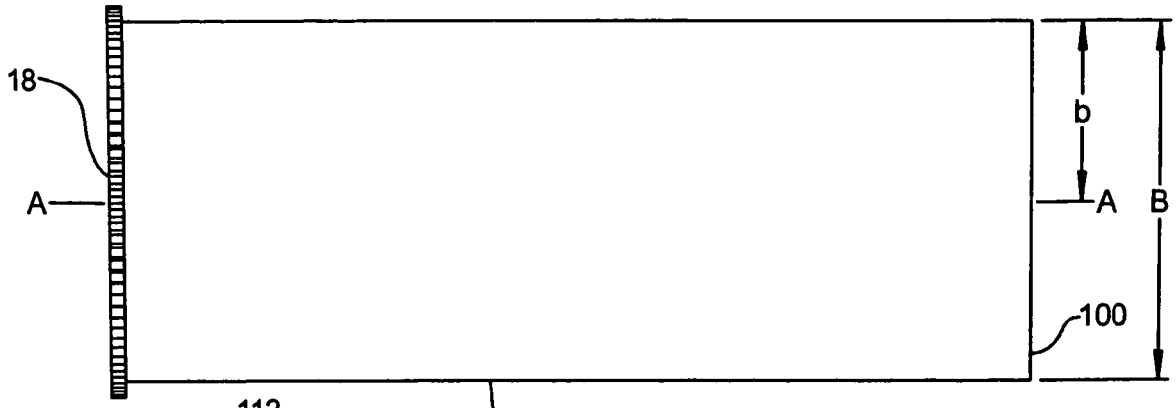
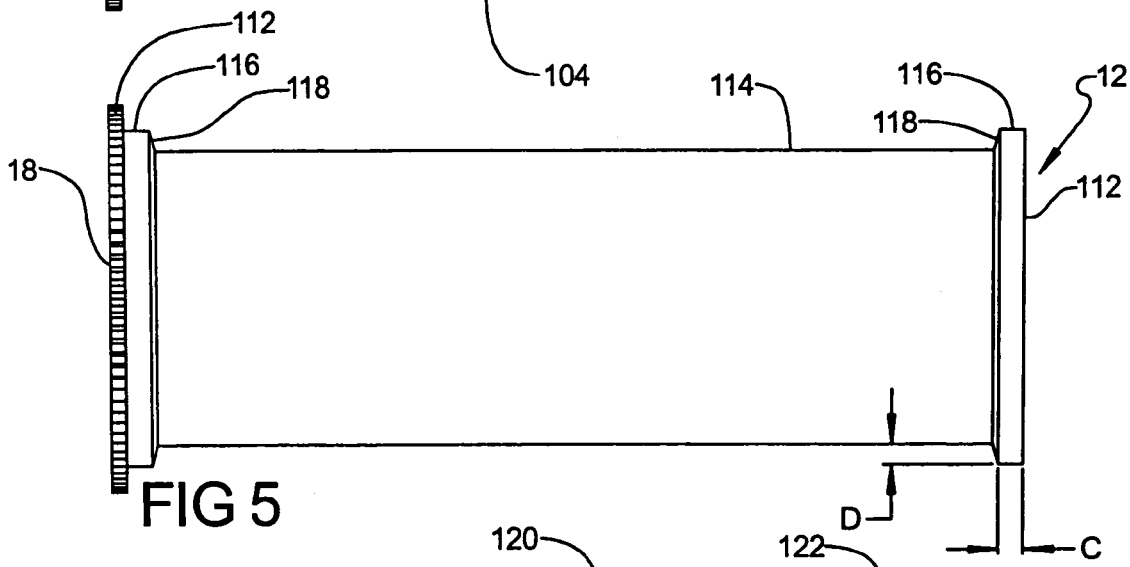
FIG 5
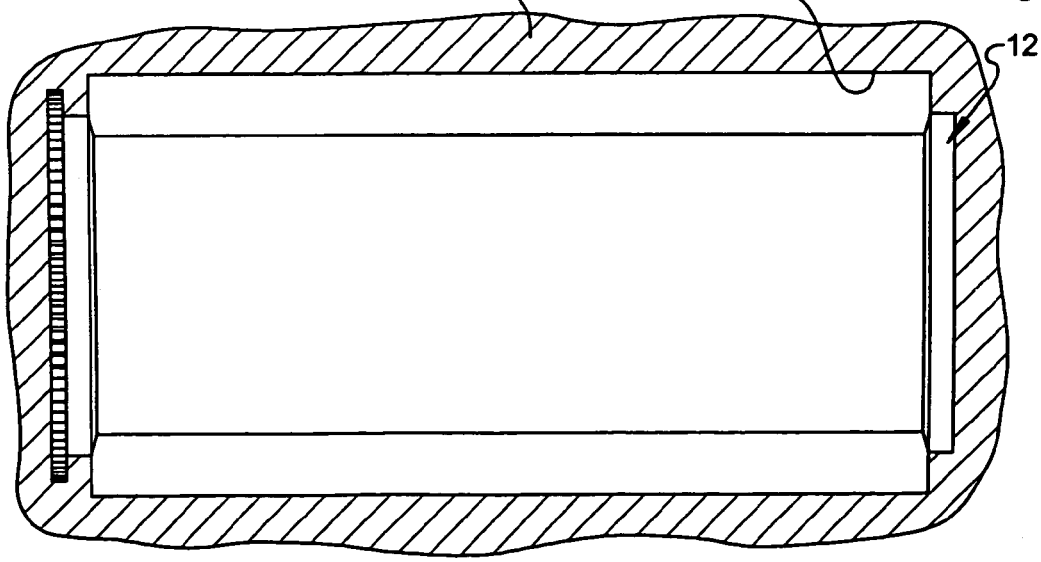
FIG 6

FIG 7
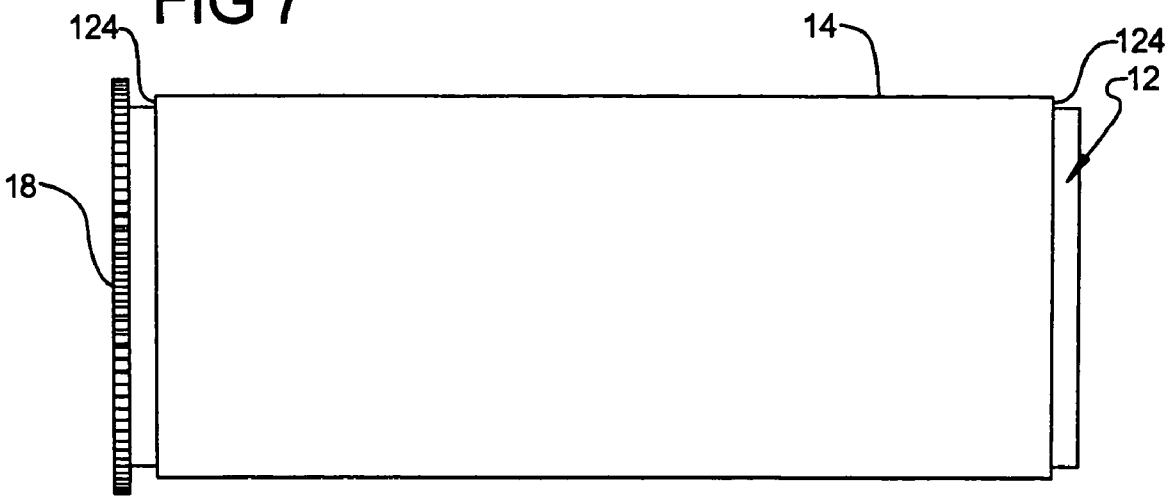
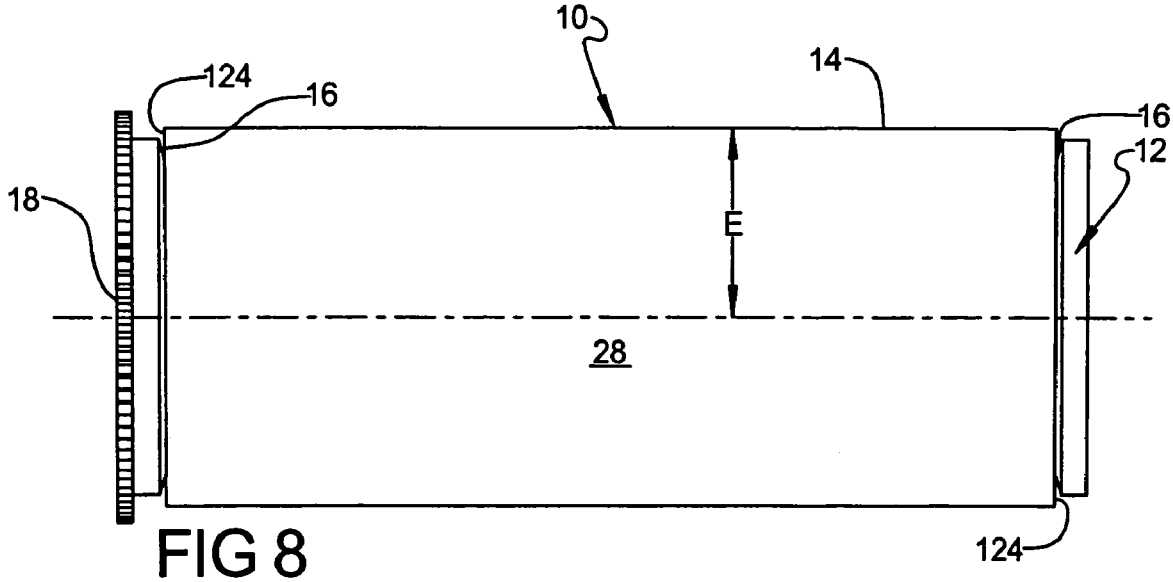
FIG 8
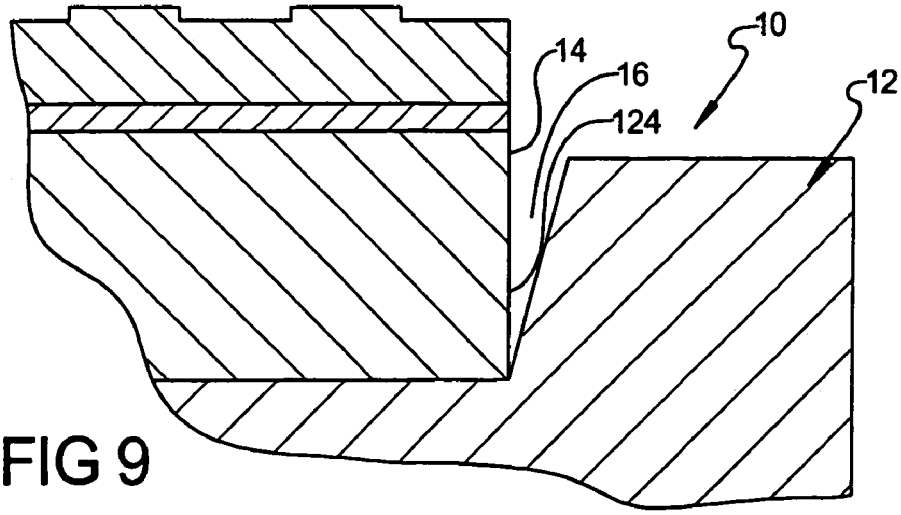
FIG 9

APPARATUS AND METHOD OF ENHANCING PRINTING PRESS CYLINDERS

FIELD OF THE INVENTION

The present invention relates to printing press cylinders and, more particularly, relates to printing press cylinders capable of enhancing print quality.

BACKGROUND OF THE INVENTION

In the printing industry, flexographic printing systems are often used as an economical alternative to higher-priced printing systems, such as offset and rotogravure printing. Flexographic printing systems typically include a flexographic printing plate formed from a flat substrate that is deformed and mounted to a printing press cylinder. A raised image may be formed on the printing plate either before or after the printing plate is attached to the printing press cylinder. Unfortunately, such printing systems require a different circumferentially sized printing press cylinder for different final image sizes and further require a separate printing press cylinder and plate assembly for each color to be printed. As one can readily appreciate, large printing plants must stock a large number of printing cylinders to accommodate a wide range of image sizes and colors to be used. With each printing cylinder ranging in price between $100 and $800, the need to stock a large number of printing cylinders can lead to a substantial capital investment.

However, the number of cylinders required can be reduced through the use of interchangeable sleeves that are installed on the printing cylinder. These interchangeable sleeves provide a number of advantages over printing plates, such as providing convenient interchangeability between printing sleeves and printing cylinders. As one skilled in the art will appreciate, sleeve interchangeability reduces the need to stock a plurality of printing cylinders and further reduces the associated capital investment.

In an attempt to vary the circumferential size of the printing plate or sleeves, it is known to apply a rubber covering to the printing cylinder or printing sleeve to thus accommodate various image sizes. This rubber covering is often as much as 0.375" to 1.00" thick. Typically, the rubber covering is fabricated directly onto the printing cylinder or fabricated onto a print sleeve, which in turn is mounted to the printing cylinder by known air expansion methods. Unfortunately, these rubber-covered cylinders suffer from a number of disadvantages. In particular, these rubber-covered cylinders require the use of a high temperature vulcanizing process in the manufacture thereof. This process can damage or deform the underlying printing cylinder or print sleeve because of the high temperatures. Furthermore, the vulcanizing process requires cure periods of about a couple hours under pressure to a few days in open air, which adversely effects production throughputs, and finally results in a heavy and cumbersome product that is difficult to handle.

As is known to one skilled in the art, much of the industry is standardized—standard-sized printing cylinders, standard printing pitches (repeats), and standard gear systems. More particularly, much of the industry employs a standard gear system in combination with a standard printing cylinder/printing sleeve circumference to achieve a standard print pitch. Unfortunately, the use of rubber-covered printing cylinders disrupts this standardization in that the rubber covering is added to an existing printing cylinder, thereby changing its circumference and the corresponding print pitch without changing the corresponding gear system. This leads to printing systems that require the use of non-standard, and thus expensive, components.

Flexographic printing systems are often separated into four groups, which include wide web systems, towel and tissue mid web, flexible packaging, folding carton, preprint, and corrugated post print such as those generally between about two feet and ten feet in length, and narrow web systems, such as those generally less than about two feet in length. Wide web systems and narrow web systems differ considerably in that wide web systems do not generally suffer from the same problems as narrow web systems. For instance, it has been common for conventional narrow web flexographic printing systems to suffer from gear marking and impression latitude. Gear marking is a banding of ink in the cross-web direction caused in part by the mechanical interference, such as bounce or chatter, in the gear system driving the narrow web printing cylinder. More particularly, it is believed that this banding is caused from the non-uniform application of pressure from the printing cylinder onto the printing media as the gear teeth enmesh. Wide web systems tend not to be effected as severely by such non-uniform application of pressure, perhaps due to the larger contact surface area available to dissipate such energy.

Still further, conventional narrow web systems traditionally suffer from a lack of impression latitude. Impression latitude is the ability to increase impression without significantly affecting dot gain, slur, color density, reverses, and press speeds, which insures uniform print quality when impression increases due to thickness variation within a plate or cylinder. It is commonly recognized that thicker cushion members (i.e. foam tape) disposed between the printing cylinder and the printing sleeve provide greater impression latitude. However, in conventional narrow web systems there is not typically sufficient area between standard-sized cylinders and standard-sized plates or sleeves to accommodate oversized cushion members. Additionally, such cushion members are relatively expensive and often break down thereby losing their ability to provide any resiliency in narrow web applications.

Still further, the introduction of these cushion members between the printing plates or sleeve and the printing cylinder may cause a variation in the thickness dimension at various points along the outer surface of the printing plate or sleeve. This results in high or low spots in the outer printing surface. This thickness variation is relatively large, typically at least about 0.002 to 0.005". The prior art rubber coverings also have a limited impression range. Impression range is generally understood as the engagement distance to which the surface of the print substrate can be depressed by the print indicia during the printing operation without causing substantial visible reduction in print performance. For conventional high performance printing, the impression range will not exceed about 0.008".

Accordingly, there exists a need in the relevant art to provide an enhanced printing press cylinder and method of manufacturing the same that is capable of reducing the effects of gear marking (ink banding) and improving impression latitude. Furthermore, there exists a need in the relevant art to provide an enhanced printing press cylinder and method of manufacturing the same that is capable of overcoming the limitations of conventional systems, such as dot gain, slur, and inconsistency. Still further, there exists a need in the relevant art to provide an enhanced printing press cylinder and method of manufacturing the same that is capable of improving production throughput and reducing production complexity. Lastly, there exists a need in the relevant art to provide an enhanced printing press cylinder and method of manufacturing the same that is capable of overcoming the disadvantages of the prior art.

SUMMARY OF THE INVENTION

According to the principles of the present invention, a printing press cylinder is provided having an advantageous construction and method of manufacture. The printing press cylinder includes a rigid base member having a reduced radius section and a polymer layer formed about the rigid base member generally within the reduced radius section. The polymer layer is operable to absorb forces and dissipate energy that degrades print quality. A gear portion is operably coupled to the rigid base member for rotation therewith. The printing press cylinder is manufactured by turning a rigid base member to produce a reduced radius section and subsequently molding a polymer layer generally within the reduced radius section of the rigid base member. The polymer layer is cured and then turned to reduce the circumference thereof and produce a smooth surface.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 4 is a front view illustrating a printing press cylinder;

FIG. 5 is a front view illustrating a reduced radius section being formed in the printing press cylinder of FIG. 4;

FIG. 6 is a partial cross-sectional view illustrating the printing press cylinder of FIG. 5 disposed in a mold, wherein the printing press cylinder receives a polymer layer thereon;

FIG. 7 is a front view illustrating the printing press cylinder of FIG. 6 with a portion of the polymer layer shown in phantom being removed;

FIG. 8 is a front view illustrating the printing press cylinder of FIG. 7 with the pair of channels formed therein; and FIG. 9 is an enlarged cross-sectional view illustrating the printing press cylinder of the present invention with a printing plate or sleeve.

DETAILED DESCRIPTION OF THE PREFERRED EMBODIMENT

The following description of the preferred embodiment is merely exemplary in nature and is in no way intended to limit the invention, its application, or uses.

Figure 1:
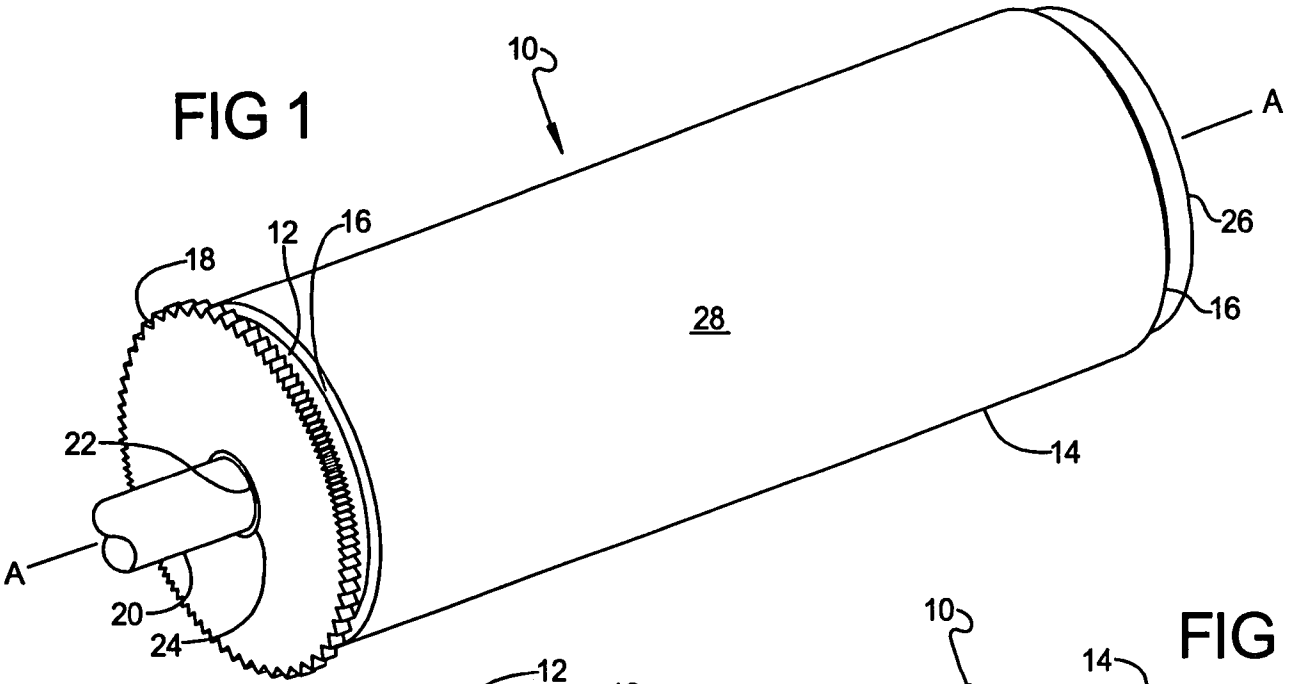
FIG. 1 is a perspective view illustrating a printing press cylinder according to the principles of the present invention.
Figure 3:
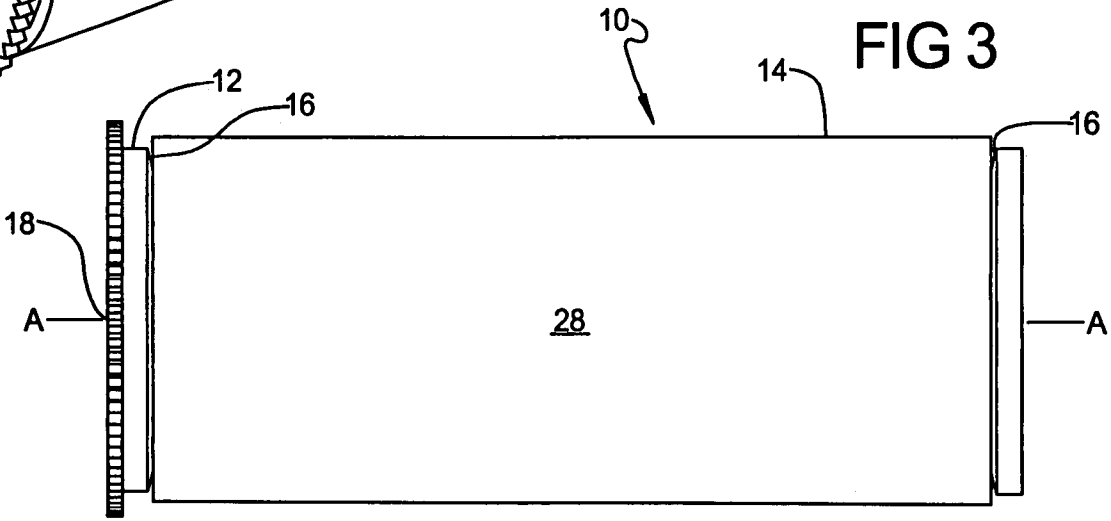
FIG. 3 is a front view illustrating the printing press cylinder according to the principles of the present invention.
Figure 2:
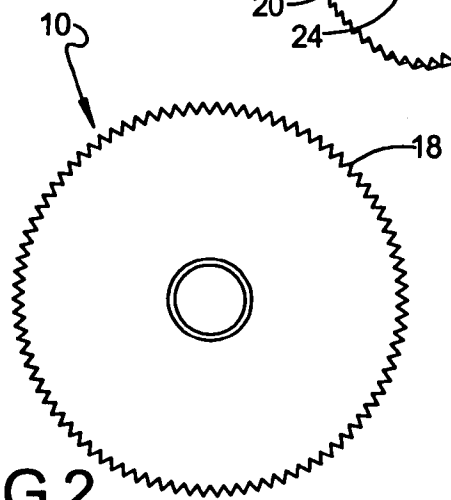
FIG. 2 is a side view illustrating the printing press cylinder according to the principles of the present invention.

Referring to FIGS. 1–3, a printing press cylinder, generally indicated at 10, is illustrated in accordance with the principles of the present invention. Printing press cylinder 10 of the present invention provides a number of distinct advantage over the prior art, such as, but not limited to, increased impression latitude, up to about 0.015"; increased production rates; reduced downtime; reduced setup time; reduced gear marking; reduced dot gain; reduced slur; and improved product consistency. These benefits, in addition to many others, are achieved through the novel construction of printing press cylinder 10. These benefits are particularly advantageous in the cost-constrained narrow web printing industry; however, these benefits are equally applicable to wide web printing applications. Therefore, the discussion set forth below should not be regarded as being limited to narrow web printing applications, but should be understood as being applicable also to wide web applications.

Still referring to FIGS. 1–3, printing press cylinder 10 is generally cylindrical in construction and is adapted to receive a printing member 200 thereon, such as a plate or sleeve (FIG. 9). Printing member 200 includes a print indicia 202 that is used to print on a print substrate. Printing press cylinder 10 includes a rigid base member 12 supporting a centrally located polymer portion 14. A pair of channel portions 16 is formed on opposing ends of central polymer portion 14 and a gear portion 18 is fixedly coupled to rigid base member 12 for rotation therewith.

Gear portion 18 is preferably sized to enmeshing engage corresponding portions of a standardized conventional gear system (not shown) to rotatably drive printing press cylinder 10 about a central axis A—A during operation. Preferably, a trunnion member 20 engages at least one axial bore 22 formed along central axis A—A to rotatably support printing press cylinder 10 during operation. To this end, axial bore 22 includes a bearing member 24 disposed therein for reduced rotational friction, as is conventional in the art. It should be understood that a second trunnion member and bearing member may be used on an opposing side 26 of printing press cylinder 10 in a similar fashion.

Central polymer portion 14 is cylindrical in cross section and defines a constant radius, which is generally represented by an outer surface 28. Central polymer portion 14 is preferably made, at least in part, of a polymer material, which will be discussed in detail below.

As best seen in FIG. 3, each of the pair of channel portions 16 is disposed on adjacent ends of central polymer portion 14. The pair of channel portions 16 defines a space between central polymer portion 14 and rigid base member 12. This space permits the free mechanical deformation or compliancy of the polymer material of central polymer portion 14. This free mechanical deformation serves to dissipate flexural energy within central polymer portion 14. This flexural energy may be caused by mechanical interference, such as bounce or chatter, in the gear system; variations in thickness of any system component; or variations in thickness of the print substrate. The polymer material of central polymer portion 14 is free to flex or otherwise bulge in a direction generally parallel to central axis A—A without physical encumbrances, such as cylinder walls along the edges of central polymer portion 14.

Through testing, it has been found that the inclusion of the pair of channel portions 16 in printing press cylinder 10 provides a remedy to gear marking problems that is so prevalent in prior art systems. By way of non-limiting example, it has been found that conventional systems often create a systematic banding of color on the substrate that is readily discernible by the consumer. The present invention, by eliminating or at least minimizing the transference of flexural energy, minimizes the chattering or bounce and consequently minimizes the presence of banding. Until now, these results were not possible without using expensive and cumbersome systems other than flexographic printing.

Referring now to FIGS. 4–9, a method of manufacturing printing press cylinder 10 will now be described in detail. However, it should be understood that the following methodology might be varied without deviating from the principles of the present invention. In particular, the following methodology will be described in connection with the remanufacturing of existing printing press cylinders. However, it is anticipated that the present invention may be manufactured from virgin materials.

As mentioned above, the present invention and the method of making the same is particularly advantageous in retrofitting existing printing press cylinders to provide the advantages of the present invention without having to purchase non-standard sized plates, sleeves, gears, and the like. Therefore, the initial step, as seen in FIG. 2, is the acquisition of a conventional aluminum printing press cylinder 100. Conventional printing press cylinder 100 includes a gear portion 18 fixedly mounted to a central tube member 104 and a pair of bearing members (not shown) disposed along central axis A—A thereof. Gear portion 18 and the pair of bearing members 24 may be removed from central tube member 104; however, such step is not necessary.

As can be seen in FIG. 4, central tube member 104 is cylindrical in cross-section and defines a diameter B (radius b). Diameter B is typically standardized to permit the application of a double-side foam tape between central tube member 104 and a printing plate or sleeve. Traditionally, foam tape 108 is about 0.015" thick and tends to break down over time causing the overall circumference of the printing cylinder and plate assembly to vary thereby adversely effecting print quality.

Turning now to FIG. 5, central tube member 104 is then turned on a lathe or similar machine to reduce an outer radius thereof. Specifically, using a cutting tool and lathe, central tube member 104 is reduced in radius starting at a position generally spaced apart from ends 112 a distance C (approximately 0.400" in the present embodiment). The outer radius of central tube member 104 is reduced a distance D (approximately 0.375" in the present embodiment) relative to its initial outer radius b. Consequently, a reduced radius section 114 having original radius sections 116 on opposing ends thereof is produced. A transition 118 between reduced radius section 114 and original radius sections 116 may be formed. However, the shape or profile of transitions 118 is primarily dependent upon the cutting method used in creating reduced radius section 114. Therefore, their exact angle is not critical. This resultant member is rigid base member 12.

Reduced radius section 114 is formed in order to receive a polymer material therein to create a final printing press cylinder that defines a standardized circumferential size. As mentioned above, this eliminates the need to use non-standard printing components. To this end, reduced radius section 114 is first treated with a primer adhesive to encourage the coupling of the polymer material therewith.

As seen in FIG. 6, rigid base member 12 having reduced radius section 114 is then positioned within a mold 120 having a mold cavity 122 for encapsulations of the polymer material. Mold cavity 122 is preferably larger in radius than original radius b of rigid base member 12 to permit the forming of an oversized polymer layer thereon that can be later cut to the appropriate circumference. By way of non-limiting example, the radius of the present embodiment is approximately 0.250" larger in radius than original radius b.

Mold 120 and associated polymer components are then heated to a temperature of about 100 degrees C. for about two hours. It is most preferable to use a TDI-based urethane system for its improved solvent resistance and low resilience and compression set values. However, it should be understood that other materials may be used. It has been determined that a polymer material having a Durometer of 40 Shore A provides satisfactory results and maintains the proper "softness." However, it should be understood that polymers having other Durometer values may be used, although it is desirable that the Durometer value of central polymer portion 14 and the Durometer value of the printing plate or sleeve are chosen with the following principle in mind. Specifically, it has been found that when central polymer portion 14 has a Durometer value of about 10 to 15 lower than the Durometer value of the printing plate or sleeve, the proper energy absorption is maintained in the invention. This arrangement greatly improves the impression latitude of printing press cylinder 10. Experiments have shown that impression latitudes of about 0.015" can be achieved with the present invention.

Once the polymer material is introduced into mold cavity 122, the assembly is cured at 100 degrees C. for 16 hours before further curing and demolding. As best seen in FIG. 7, central polymer portion 14 is shown molded upon rigid base member 12, thereby defining printing press cylinder 10.

Printing press cylinder 10 is then turned on a lathe or similar machine to reduce the radius of central polymer portion 14 to form the final dimensions of printing press cylinder 10. While on the lathe, printing press cylinder 10 is machined to form a smooth and concentric main outer surface 28. Conventionally, grinding wheels or sanding steps have been used to reduce the outer radius; however, they often produce inaccurate pieces that fail to properly mount with printing sleeves. Central polymer portion 14 is reduced in radius such that the outer radius, generally indicated at E (FIG. 8), is 0.010" larger than outer radius b of original radius sections 116. This enables the replacement of conventionally used 0.015" and 0.020" foam tape with the less expensive 0.005"-thick and/or 0.002"-thick double-sided adhesive tape for printing plate mounting. It has been determined that such a substitution in tape equates to about a 50% cost savings, which is substantial.

Referring now to FIG. 8, the pair of channel portions 16 is then cut into central polymer portion 14 of printing press cylinder 10 using a cutting knife and lathe. As best seen in FIG. 9, the edges 124 of central polymer portion 14 are cut back from rigid base member 12 to reveal free ends, which do not substantially contact any surface generally inhibiting their movement in a direction generally parallel to central axis A—A. As mentioned above, the pair of channel portions 16 serves to provide a gap to accommodate mechanical deformation of the polymer material of central polymer portion 14. In other words, central polymer portion 14 is free to flex or otherwise bulge to dissipate energy without physical encumbrances. Finally, bearing members 24 and gear portion 18 are reassembled to printing press cylinder 10, if previously removed.

It should be readily appreciated, the present invention provides a number of advantages. For example, the present invention provides a means to convert existing printing cylinders into systems that are capable of eliminating or at least minimizing gear marking, without enduring the substantial cost of replacing current stocks of printing cylinders. The present invention further provides an enhanced printing press cylinder whose circumferential size can be increased slightly to account for the use of reduced thickness adhesive tape, thereby reducing a plant's reliance on expensive foam tapes. This leads to improved consistency since typical double-side adhesive tape does not break down like foam tapes, which tend to vary the production run.

Additionally, the enhanced printing press cylinder of the present invention may further have enlarged central polymer portions that enable the printing member (i.e. sleeve or plate) to be thinner in construction without adversely effecting the outer circumference. Thus, cost savings may be realized through reduced cost printing members and the ability to use standard gear components.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A printing press cylinder for supporting a printing member, said printing press cylinder comprising:

a rigid base member having a reduced radius section;

a polymer layer formed about said rigid base member generally within said reduced radius section, said polymer layer operable to absorb forces;

a gear portion operably coupled to said rigid base member for rotation therewith; and a pair of channels formed between at least a portion of said rigid base member and opposing ends of said polymer layer.

2. The printing press cylinder according to claim 1 wherein said reduced radius section is positioned between a pair of original radius sections having a transition surface extending therebetween.

3. A printing press assembly comprising:

a rigid base member having a reduced radius section;

a polymer layer formed about said rigid base member generally within said reduced radius section, said polymer layer operable to absorb forces;

a gear portion operably coupled to said rigid base member for rotation therewith;

an outer printing member having a printing indicia formed thereon;

an adhesive member disposed between said polymer layer and said outer printing member operable to at least in part retain said outer printing member to said polymer layer; and a pair of channels formed between at least a portion of said rigid base member and opposing ends of said polymer layer.

4. The printing press assembly according to claim 3 wherein said reduced radius section is positioned between a pair of original radius sections having a transition surface extending therebetween.

5. A printing press assembly comprising:

a rigid base member having a reduced radius section, said reduced radius section being positioned between a pair of original radius sections;

a polymer layer formed about said rigid base member generally within said reduced radius section, a radius of said polymer layer being larger than a radius of the pair of original radius sections; and a gear portion operably coupled to said rigid base member for rotation therewith; and a pair of channels formed between at least a portion of said rigid base member and opposing ends of said polymer layer.

* * * * *